US010612434B2

(12) United States Patent
Franke et al.

(10) Patent No.: US 10,612,434 B2
(45) Date of Patent: Apr. 7, 2020

(54) SLIDING CAM SYSTEM AND METHOD FOR OPERATING AN INTERNAL COMBUSTION ENGINE

(71) Applicant: MAN Truck & Bus AG, München (DE)

(72) Inventors: Sören Franke, Chemnitz (DE); Thilo Kowalschek, Colditz (DE); Fabian Zeil, Chemnitz (DE); Heiko Neukirchner, Chemnitz (DE)

(73) Assignee: MAN TRUCK & BUS AG, München (DE)

( * ) Notice: Subject to any disclaimer, the term of this patent is extended or adjusted under 35 U.S.C. 154(b) by 0 days.

(21) Appl. No.: 16/045,495

(22) Filed: Jul. 25, 2018

(65) Prior Publication Data

US 2019/0032524 A1 Jan. 31, 2019

(30) Foreign Application Priority Data

Jul. 27, 2017 (DE) ..... 10 2017 116 987

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/053* (2013.01); *F01L 1/08* (2013.01); *F01L 1/185* (2013.01);
(Continued)

(58) Field of Classification Search
CPC ..... F01L 1/08; F01L 13/0036; F01L 1/185; F01L 2013/0052
(Continued)

(56) References Cited

U.S. PATENT DOCUMENTS 4,522,085 A 6/1985 Kane
8,863,714 B1 10/2014 Moran et al.
(Continued)

FOREIGN PATENT DOCUMENTS

DE 19611641 C1 6/1997
DE 102010025100 A1 12/2011
(Continued)

OTHER PUBLICATIONS

Di Nunno, Internal Combustion Engine Comprising a Shifting Cam System for Variable Valve Actuation, U.S. Pat. No. 2017/0167325 A1, dated Jun. 15, 2017. (Year: 2017).*

*Primary Examiner* — Ching Chang
(74) *Attorney, Agent, or Firm* — Weber Rosselli & Cannon LLP

(57) ABSTRACT

A sliding cam system for a variable valve train. The sliding cam system includes a camshaft, a cam carrier, a cam follower, and a first actuator. A first cam of the cam carrier and a second cam of the cam carrier are arranged offset with respect to one another along a longitudinal axis of the camshaft. The first cam comprises a base circle region and a valve lift region with a limiting section which adjoins the base circle region of the first cam. The second cam has a base circle region and a valve lift region with a limiting section which adjoins the base circle region of the second cam. The limiting section of the first cam and the limiting section of the second cam are of identical configuration and are arranged at an identical circumferential position about the longitudinal axis of the camshaft.

23 Claims, 4 Drawing Sheets

(51) Int. Cl.
*F01L 1/08* (2006.01)
*F01L 1/053* (2006.01)
*F01L 1/18* (2006.01)

(52) U.S. Cl.
CPC . *F01L 2013/0052* (2013.01); *F01L 2013/101* (2013.01); *F01L 2105/00* (2013.01)

(58) Field of Classification Search
USPC ..... 123/90.16, 90.18, 90.39, 90.44, 90.6
See application file for complete search history.

(56) References Cited

U.S. PATENT DOCUMENTS

| | | | |
|---|---|---|---|
| 2007/0034182 | A1 | 2/2007 | Dengler |
| 2015/0075468 | A1 | 3/2015 | Takagi et al. |

FOREIGN PATENT DOCUMENTS

| | | | |
|---|---|---|---|
| DE | 102012209860 | A1 | 12/2013 |
| DE | 102012112482 | A1 | 6/2014 |
| GB | 2545257 | A | 6/2017 |

* cited by examiner

SLIDING CAM SYSTEM AND METHOD FOR OPERATING AN INTERNAL COMBUSTION ENGINE

BACKGROUND

The present disclosure relates to a sliding cam system for a variable valve train, to a variable valve train, to a motor vehicle and to a method for operating an internal combustion engine.

Valve-controlled internal combustion engines comprise one or more controllable inlet and outlet valves per cylinder. Variable valve control systems make flexible actuation of the valves possible in order to change the opening time, closing time and/or the valve lift. As a result, the engine operation can be adapted, for example, to a specific load situation.

DE 196 11 641 C1 has disclosed a valve train, by way of which the actuation of a gas exchange valve using a plurality of different lift curves is made possible. To this end, a sliding cam with at least one cam section which comprises a plurality of cam tracks is mounted on the camshaft fixedly so as to rotate with it but such that it can be displaced axially, which sliding cam comprises a lift contour, into which an actuator in the form of a pin is introduced radially from the outside in order to produce an axial displacement of the sliding cam. By way of the axial displacement of the sliding cam, a different valve lift is set at the respective gas exchange valve. After the axial displacement of the sliding cam relative to the camshaft, said sliding cam is latched in its axial relative position on the camshaft by virtue of the fact that at least one spring-loaded latching ball which is received and mounted in the camshaft engages into at least one latching groove in a manner which is dependent on the axial relative position. The axial displacement of the sliding cam in order to change the valve lift takes place exclusively in what is known as the base circle of the or each cam section or the cam tracks thereof. As a result, the switching rotational speed of the valve train is limited.

The shorter the base circles of the cams which coincide with one another, the less time is available for the axial displacement of the sliding cam. The less time is available for the axial displacement of the sliding cam system, the steeper the ramp of the switching guide plate (engagement track) has to be configured. In the case of the axial displacement of the sliding cam, considerable forces can occur in part in the case of the contact between the pin of the actuator and the switching guide plate. Particularly great forces can occur, in particular, in the case of steep ramps, which particularly great forces can have a negative influence on the service life of the sliding cam system and/or limit a maximum switching rotational speed.

DE 10 2012 112 482 A1 has disclosed a method for operating an internal combustion engine having a plurality of cylinders. In order to actuate gas exchange valves, the internal combustion engine comprises a valve train with at least one rotatably mounted camshaft and with at least one sliding cam which can be displaced axially on the respective camshaft. The respective sliding cam comprises at least one guide plate section with at least one groove which is configured on an outer circumferential face of the respective guide plate section, the respective sliding cam comprising at least one cam section with a plurality of cam tracks for setting different valve lifts. In order to bring about an axial displacement of the respective sliding cam, an actuable pin of an actuator is introduced radially from the outside into a groove of the guide plate section. The axial displacement of the respective sliding cam is carried out in a manner which is dependent on the axial displacement direction of said sliding cam and/or in a manner which is dependent on a valve play outside a base circle of the or each cam section of said sliding cam.

SUMMARY

The present disclosure is based on the object of providing an alternative or improved sliding cam system and a method for operating an internal combustion engine, in the case of which the forces which occur during the displacement operation of the cam carrier are reduced in comparison with conventional systems.

The sliding cam system is configured for a variable valve train of an internal combustion engine of a motor vehicle, in particular a commercial vehicle. The sliding cam system comprises a camshaft and a cam carrier. The cam carrier is arranged on the camshaft fixedly so as to rotate with it and such that it can be displaced axially between a first axial position and a second axial position, and comprises a first cam, a second cam and a first engagement track for the axial displacement of the cam carrier. The sliding cam system comprises a cam follower which is operatively connected to the first cam in the first axial position of the cam carrier and is operatively connected to the second cam in the second axial position of the cam carrier. The sliding cam system comprises a first actuator which comprises an element which can be retracted and extended, in particular a pin, for engaging into the first engagement track for the axial displacement of the cam carrier. The first cam and the second cam are arranged offset with respect to one another along a longitudinal axis of the camshaft. The first cam comprises a base circle region and a valve lift region with a limiting section which adjoins the base circle region of the first cam. The second cam comprises a base circle region and a valve lift region with a limiting section which adjoins the base circle region of the second cam. The limiting section of the first cam and the limiting section of the second cam are of identical configuration and are arranged at an identical circumferential position about the longitudinal axis of the camshaft. The first actuator, the cam follower and the first engagement track are arranged and configured in such a way that an axial displacement of the cam carrier can be carried out while the cam follower is operatively connected to the limiting section of the first cam and/or the limiting section of the second cam.

The sliding cam system makes an extension of the available time period for the axial displacement of the cam carrier possible by way of an expansion into the limiting sections of the cams. On account of the larger switching region, the accelerations and therefore the mass forces can be reduced in the case of an identical switching rotational speed for the axial displacement. This can firstly be utilized, for example, to increase the functional reliability and service life on account of lower forces and pressures. Secondly, this can be utilized, for example, to increase the maximum switching rotational speed of the system.

In particular, the first cam can be configured so as to directly adjoin the second cam.

In one particularly preferred embodiment, the first actuator, the cam follower and the first engagement track are arranged and configured in such a way that an axial displacement of the cam carrier begins and/or ends while the cam follower is operatively connected to the limiting section of the first cam or the limiting section of the second cam. In this way, in particular, the beginning and/or the end of the axial displacement of the cam carrier can be moved into the limiting regions. In this way, the available time duration for the axial displacement of the cam carrier can be extended.

In one embodiment, the limiting sections extend over a region of greater than or equal to 1° camshaft angle.

In one development, the limiting sections extend over a region between 5° and 45° camshaft angle, in particular between 15° and 30° camshaft angle.

In a further embodiment, the limiting sections form a common flat ramp.

In one design variant, the limiting sections are arranged in a run-out region of the first and second cam. As an alternative or in addition, the axial displacement of the cam carrier begins when the cam follower is operatively connected to the limiting section of the first cam or the second cam. The axial displacement preferably ends while the cam follower is operatively connected to the base circle region of the first cam or the second cam. It is also possible, however, that the axial displacement does not end until in a further limiting section in a run-in region of the first or second cam, the further limiting sections of the first and second cam once again being of identical configuration and being arranged at an identical circumferential position about the longitudinal axis of the camshaft.

In a further design variant, the limiting sections are arranged in a run-in region of the first and second cam. As an alternative or in addition, the axial displacement of the cam carrier ends when the cam follower is operatively connected to the limiting section of the first cam or the second cam. The axial displacement of the cam carrier preferably begins while the cam follower is operatively connected to the base circle region of the first cam or the second cam. It is also possible, however, the axial displacement already begins in another limiting section in a run-out region of the first or second cam, the other limiting sections of the first and second cam once again being of identical configuration and being arranged at an identical circumferential position about the longitudinal axis of the camshaft.

In one exemplary embodiment, the cam carrier comprises a second engagement track for the axial displacement of the cam carrier in an opposed direction with respect to an axial displacement which is brought about by the first engagement track. Furthermore, the sliding cam system comprises a second actuator which comprises an element which can be retracted and extended, in particular a pin, for engaging into the second engagement track for the axial displacement of the cam carrier. The second actuator, the cam follower and the second engagement track are arranged and configured in such a way that an axial displacement of the cam carrier can be carried out (in particular, begins and/or ends) while the cam follower is operatively connected to the limiting section of the first cam or the limiting section of the second cam.

In particular, the first actuator and the second actuator can be provided separately from one another. It is also possible, however, that the first actuator and the second actuator are provided in a common housing.

The first engagement track and the second engagement track are preferably provided separately from one another. It is also possible, however, that the first engagement track and the second engagement track are arranged in an identical region of the cam carrier. The first engagement track and the second engagement track can preferably cross one another.

In a further exemplary embodiment, the first engagement track has a cross-sectional constriction for the reduction of the play between the first engagement track and that element of the first actuator which can be retracted and extended during the engagement (of the extended element into the first engagement track). The cross-sectional constriction is arranged in such a way that the reduction in the play takes place before the cam follower passes into an operative connection with the limiting section of the first cam or the second cam. In this way, that section of the engagement track which is provided for the reduction of the play does not shorten that section of the engagement track which is provided for the axial displacement of the cam carrier.

In order to achieve the same advantages, it is also possible that the second engagement track comprises a cross-sectional constriction for the reduction of the play between the second engagement track and that element of the second actuator which can be retracted and extended during the engagement (of the extended element into the second engagement track). The cross-sectional constriction is arranged in such a way that the reduction in the play takes place before the cam follower passes into an operative connection with the limiting section of the first cam or the second cam.

In one particularly preferred embodiment, the first engagement track and/or the second engagement track extend/extends spirally about the longitudinal axis of the camshaft.

In a further embodiment, that element of the first actuator and/or the second actuator which can be retracted and extended can be moved radially with regard to the longitudinal axis of the camshaft.

The present disclosure also relates to a variable valve train for an internal combustion engine. The variable valve train comprises a sliding cam system as disclosed herein. The variable valve train comprises a gas exchange valve, in particular an inlet valve or an outlet valve, which is operatively connected to the cam follower. The first cam and the second cam bring about different valve lifts, opening times and/or closing times of the gas exchange valve.

In one development, the gas exchange valve is an outlet valve. The first cam is configured for a normal operation mode of the internal combustion engine, in the case of which normal operation mode the first cam holds the outlet valve open in the exhaust stroke. The second cam is configured for an engine braking operation mode of the internal combustion engine, in the case of which engine braking operation mode the outlet valve is preferably first of all kept closed in the compression stroke and in the exhaust stroke and is opened before a top dead centre of a piston movement is reached.

In one exemplary embodiment, the second cam is configured in such a way that the outlet valve opens between 100° crank angle and 60° crank angle (crankshaft angle) before the top dead centre is reached. As an alternative or in addition, the second cam is configured in such a way that the outlet valve closes after the opening in the exhaust stroke in the region between the top dead centre and 30° crank angle after the top dead centre. As an alternative or in addition, the second cam is configured in such a way that the outlet valve closes after the opening in the compression stroke in the region between the bottom dead centre and 30° crank angle after the bottom dead centre.

The present disclosure also relates to a motor vehicle, in particular a commercial vehicle (for example, a truck or omnibus), comprising a variable valve train as disclosed herein or the sliding cam system as disclosed herein.

The present disclosure also relates to a method for operating an internal combustion engine with a sliding cam system. The sliding cam system comprises a cam carrier which is arranged fixedly on a camshaft so as to rotate with it, can be displaced axially, and comprises a first cam and a second cam. The first cam and the second cam in each case comprise a base circle region and a valve lift region with a limiting section which is arranged adjacently with respect to the respective base circle region. The limiting section of the first cam and the limiting section of the second cam are of identical configuration and are arranged at an identical circumferential position about a longitudinal axis of the camshaft. The sliding cam system comprises a cam follower which is selectively operatively connected to the first cam or the second cam. The method comprises the axial displacement of the cam carrier, the axial displacement of the cam carrier being carried out, in particular beginning or ending, while the cam follower is operatively connected to the limiting section of the first cam and/or the second cam.

The method affords the same advantages as the sliding cam system which is disclosed herein. In addition, the method has a higher flexibility, since it is not restricted to the axial displacement of the cam carrier by means of the actuators and engagement tracks as disclosed herein.

In particular, the method can use the sliding cam system disclosed herein, preferably with elements of actuators which can be retracted and extended radially and engage into spiral engagement tracks, for the axial displacement of the cam carrier. It is also possible, however, that the method uses a different displacement system for the axial displacement of the cam carrier.

In one embodiment, the axial displacement of the cam carrier begins while the cam follower is operatively connected to the limiting section of the first cam or the second cam, and/or ends while the cam follower is operatively connected to the base circle region of the first cam or the second cam.

As an alternative or in addition, the axial displacement of the cam carrier begins while the cam follower is operatively connected to the base circle region of the first cam or the second cam, and/or ends while the cam follower is operatively connected to the limiting section of the first cam or the second cam.

The above-described embodiments and features of the present disclosure can be combined in any desired way with one another.

BRIEF DESCRIPTION OF THE DRAWINGS

Further details and advantages of the present disclosure will be described in the following text with reference to the appended drawings, in which.

DETAILED DESCRIPTION

The embodiments which are shown in the figures match one another at least partially, with the result that similar or identical parts are provided with the same reference signs, and reference is also made to the description of the other embodiments or figures in order to describe them, so as to avoid repetitions.

In the following text, a variable valve train with a sliding cam system is first of all described with reference to FIG. 1 to FIG. 4. The sliding cam system makes a switchover possible between different valve control curves of the actuated gas exchange valves. The system which is disclosed herein by way of example relates to the actuation of outlet valves of an internal combustion engine. The principles which are disclosed herein can also be applied, however, in the case of a variable valve train for one or more inlet valves.

Figure 1:
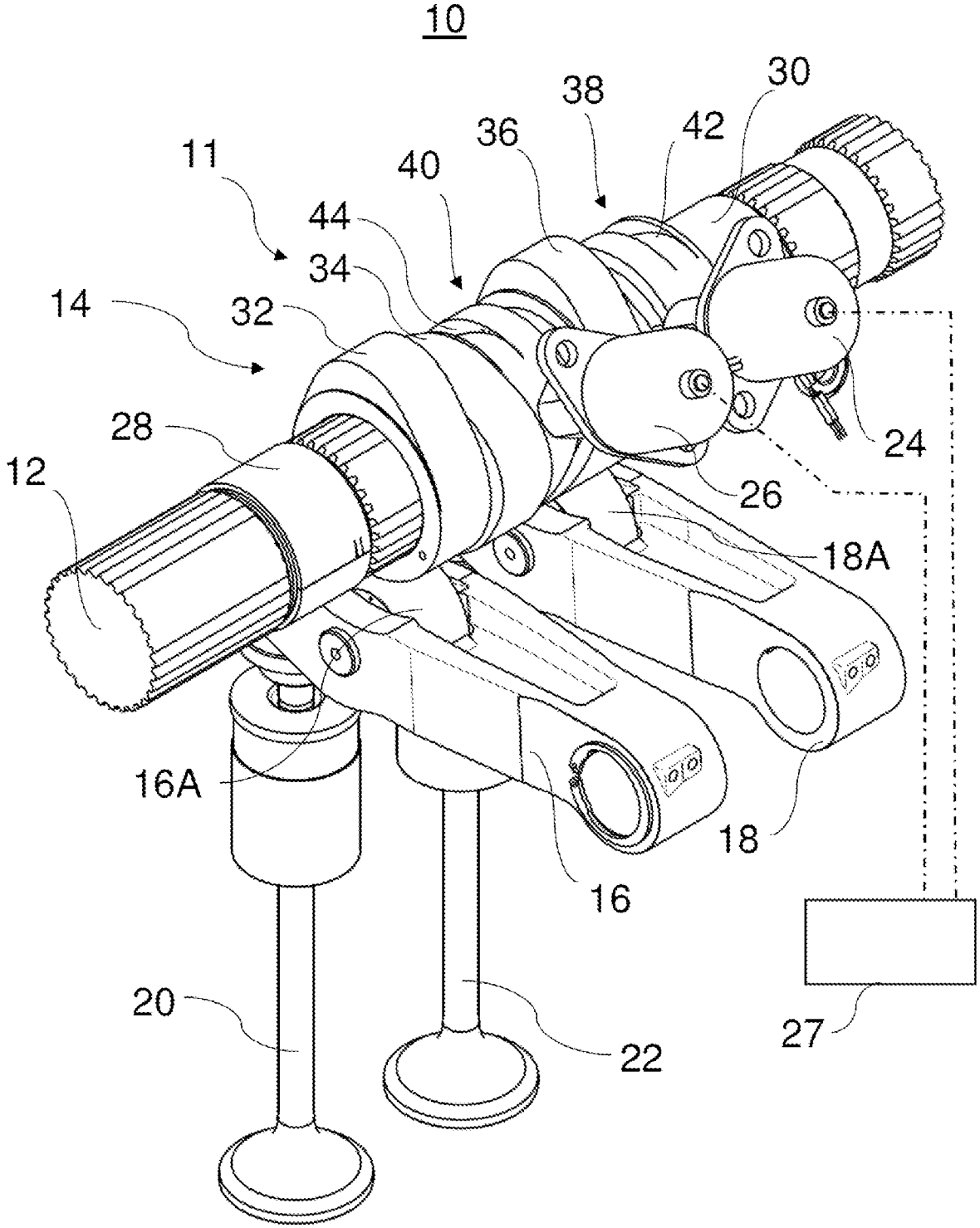
FIG. 1 shows a perspective view of an exemplary variable valve train.
Figure 2:
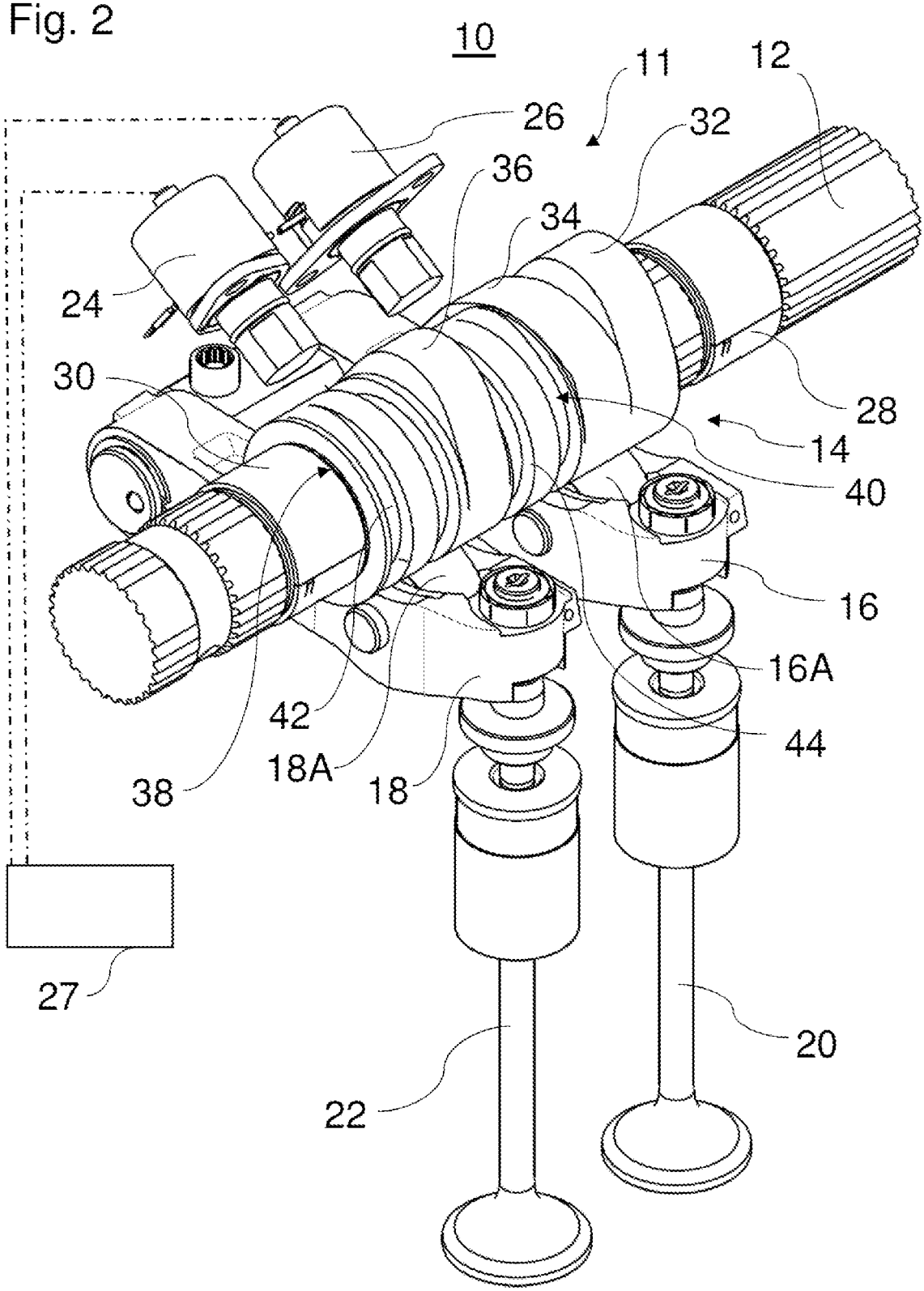
FIG. 2 shows a further perspective view of the exemplary variable valve train.
Figure 3:
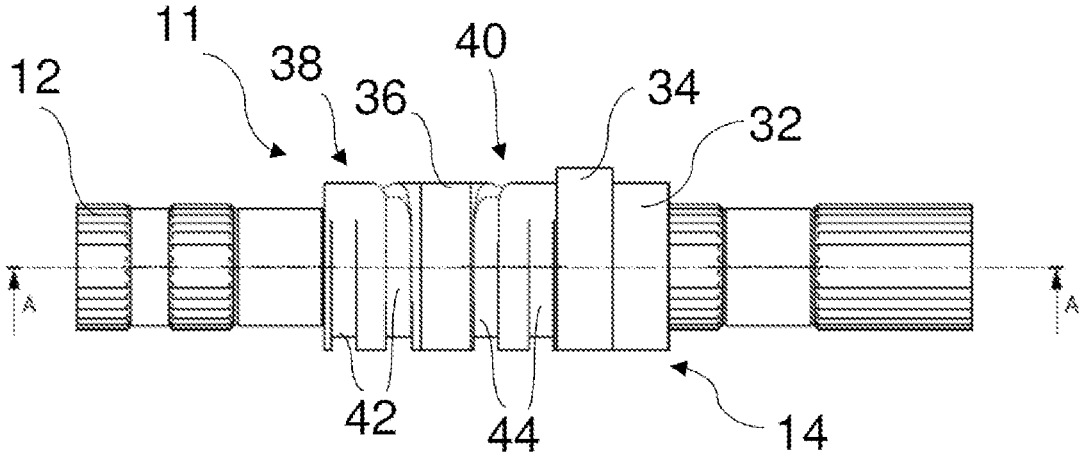
FIG. 3 shows a plan view of a camshaft of the exemplary variable valve train.

FIGS. 1 and 2 show a variable valve train 10. The variable valve train 10 comprises a camshaft 12 and a cam carrier 14. In addition, the variable valve train 10 comprises a first and second transmission apparatus 16 and 18, and a first and second outlet valve 20 and 22. In addition, the variable valve train 10 comprises a first actuator 24 and a second actuator 26. The cam carrier 14, the transmission apparatuses 16 and 18 and the actuators 24 and 26 form a sliding cam system 11.

The camshaft 12 is configured as an outlet camshaft which actuates the outlet valves 20 and 22. The camshaft 12 is part of a double camshaft system (not shown in detail) which additionally comprises an inlet camshaft (not shown) for actuating one or more inlet valves. The camshaft 12 is arranged together with the inlet camshaft as an overhead camshaft. The camshaft 12 and the inlet camshaft therefore form what is known as a DOHC system (Double Over Head Camshaft). As an alternative, the camshaft 12 might also form what is known as an SOHC system (Single Over Head Camshaft). In other embodiments, the camshaft 12 can also be arranged as an OHV camshaft.

The cam carrier 14 is arranged fixedly on the camshaft 12 so as to rotate with it. The cam carrier 14 is additionally arranged such that it can be displaced axially along a longitudinal axis of the camshaft 12. The cam carrier 14 can be displaced axially between a first stop 28 and a second stop 30.

In the following text, the cam carrier 14 is described with reference to FIGS. 1 to 4. The cam carrier 14 comprises three cams 32, 34 and 36 which are offset from one another in a longitudinal direction of the cam carrier 14 and the camshaft 12. The first cam 32 is arranged at a first end of the cam carrier 14 and is configured for a normal operation mode, as described in detail by way of example later. The second cam 34 is arranged adjacently with respect to the first cam 32 and is configured for an engine braking operation mode, as likewise described in detail by way of example later. The third cam 36 is arranged spaced apart from the second cam 34 and the second end of the cam carrier 14. The third cam 36 is configured for the normal operation mode. The third cam 36 is shaped like the first cam 32.

In addition, the cam carrier 14 has a first cam-free section 38 and a second cam-free section 40. The first cam-free section 38 is arranged at the second end of the cam carrier 14. The second cam-free section 40 is arranged between the second cam 34 and the third cam 36. In the first cam-free section 38, a first engagement track (switching guide plate) 42 extends spirally about a longitudinal axis of the cam carrier 14. In the second cam-free section 40, a second engagement track (switching guide plate) 44 extends spirally about the longitudinal axis of the cam carrier 14.

In order to displace the cam carrier 14 between the stops 28 and 30, the actuators 24 and 26 (FIGS. 1 and 2) can engage by way of extendable elements (for example, bolt or pin, not shown in detail) selectively into the engagement tracks 42, 44. In detail, the first actuator 24 can engage selectively into the first engagement track 42 for the displacement of the cam carrier 14 from one axial position to another axial position. In a first axial position, the cam carrier 14 bears against the second stop 30. In a second axial position, the cam carrier 14 bears against the first stop 28. FIGS. 1 to 4 show the cam carrier in the first axial position. The second actuator 26 in turn can engage selectively into the second engagement track 44. The cam carrier 14 is then displaced from the first axial position to the second axial position. The first actuator 24 and the second actuator 26 are actuated by a diagrammatically shown control unit 27 (FIGS. 1 and 2).

The displacement is triggered by virtue of the fact that the extended pin of the respective actuator 24, 26 is stationary with regard to an axial direction of the camshaft 12. As a consequence, the displaceable cam carrier 14 is displaced in a longitudinal direction of the camshaft 12 on account of the spiral shape of the engagement tracks 42, 44 when the extended pin engages into the respective engagement track 42, 44. At the end of the displacement operation, the pin of the respective actuator 24, 26 is guided by the respective engagement track 42, 44 in an opposed manner with respect to the extension direction and is therefore retracted. The pin of the respective actuator 24, 26 passes out of engagement with the respective engagement track 42, 44.

The first transmission apparatus 16 and the second transmission apparatus 18 (FIGS. 1 and 2) establish an operative connection between the cam carrier 14 and the outlet valves 20, 22. The first outlet valve 20 is actuated (opened) when the first cam 32 or the second cam 34 presses the first transmission apparatus 16 downward. The second outlet valve 22 is actuated (opened) when the third cam 36 presses the second transmission apparatus 18 downward.

If the cam carrier 14 is situated in the first axial position (as shown in FIGS. 1 to 4), the first transmission apparatus 16 is operatively connected via a cam follower 16A between the first cam 32 and the first outlet valve 20. In other words, the first transmission apparatus 16 is not operatively connected between the second cam 34 and the first outlet valve 20 in the first axial position of the cam carrier 14. The first outlet valve 20 is actuated in accordance with a contour of the first cam 32. In the second axial position of the cam carrier 14, the first transmission apparatus 16 is operatively connected between the second cam 34 and the first outlet valve 20 via the cam follower 16A. The first outlet valve 20 is actuated in accordance with a contour of the second cam 34.

In the first axial position of the cam carrier 14, the second transmission apparatus 18 is operatively connected between the third cam 36 and the second outlet valve 22 via a cam follower 18A. The second outlet valve 22 is actuated in accordance with a contour of the third cam 36. In the second axial position of the cam carrier 14, the second transmission apparatus 18 does not actuate the second outlet valve 22. In the second axial position of the cam carrier 14, the cam follower 18A of the second transmission apparatus 18 lies at the same axial position with regard to the camshaft 12 as the first cam-free section 38. The first cam-free section 38 does not have an elevation for actuating the second transmission apparatus 18. If the cam carrier 14 is in the second axial position, the second outlet valve 22 is not actuated.

The first cam-free section 38 therefore has two functions. Firstly, the first cam-free section 38 accommodates the first engagement track 42. Secondly, the first cam-free section 38 serves to ensure that no actuation of the second outlet valve 22 takes place in the second axial position of the cam carrier 14. This functional integration is favourable for reasons of installation space.

In the embodiment which is shown, the first transmission apparatus 16 and the second transmission apparatus 18 are configured in each case as a rocker arm. In other embodiments, the transmission apparatuses 16 and 18 can be configured as toggle levers or tappets. In some embodiments, the transmission apparatuses 16 and 18 can comprise, for example, rotatably mounted rollers as cam followers 16A, 18A.

Figure 4:
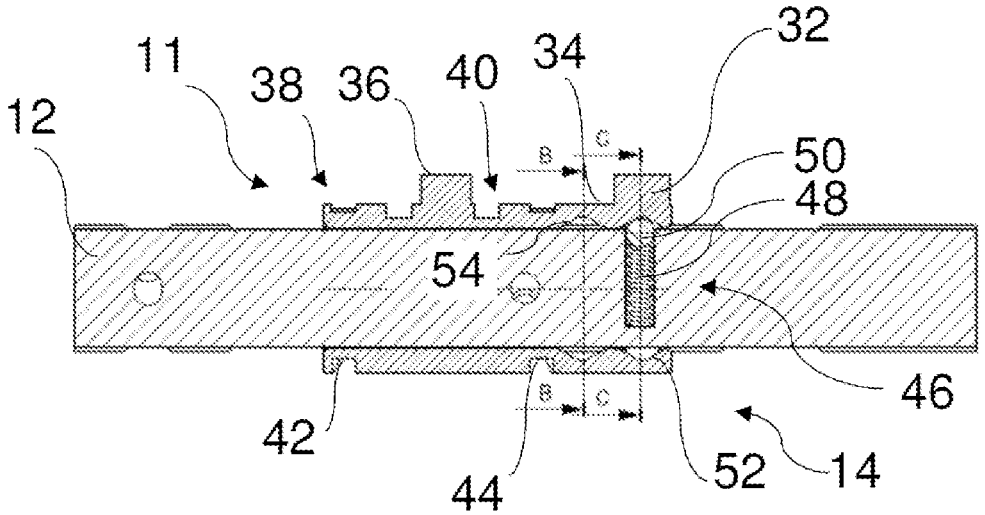
FIG. 4 shows a longitudinal sectional view of the camshaft from FIG. 3 along the line AA.

A locking apparatus 46 is shown with reference to FIG. 4. The locking apparatus 46 comprises an elastic element 48 and a locking body 50. The elastic element 48 is arranged in a blind bore of the camshaft 12. The elastic element 48 prestresses the locking body 50 against the cam carrier 14. A first and second recess 52 and 54 are arranged in an inner circumferential face of the cam carrier 14. In order to lock the cam carrier 14, the locking body 50 is pressed into the first recess 52 when the cam carrier 14 is in the first axial position. In the second axial position of the cam carrier 14, the locking body 50 is pressed into the second recess 54.

Figure 5A:
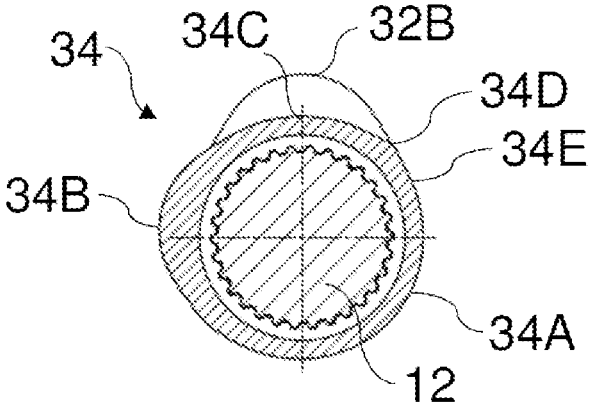
FIG. 5A shows a first cross-sectional view of the camshaft from FIG. 4 along the line B-B.

FIG. 5A shows a section through the second cam 34 along the line B-B in FIG. 4. The second cam 34 comprises a first base circle region 34A and a second base circle region 34C. The base circle regions 34A, 34C are separated from one another firstly by way of a first valve lift region 34B and secondly by way of a second valve lift region 34D. The second valve lift region 34D comprises a limiting section 34E which directly adjoins the first base circle region 34A. The limiting section 34E forms a run-out flank (ramp) of the second cam 34.

Figure 5B:
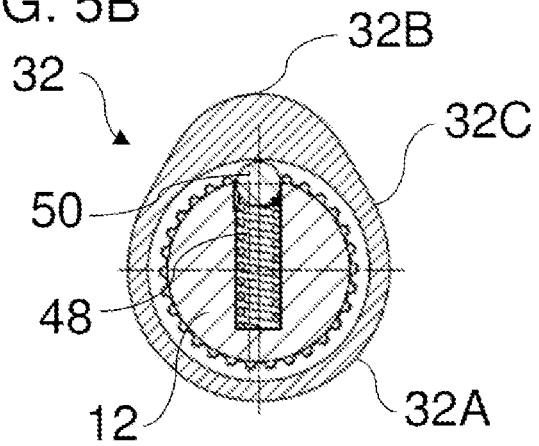
FIG. 5B shows a second cross-sectional view of the camshaft from FIG. 4 along the line C-C.

FIG. 5B shows a section through the first cam 32 along the line C-C in FIG. 4. The first cam 32 comprises a base circle region 32A and a valve lift region 32B. The valve lift region 32B comprises a limiting section 32C which directly adjoins the base circle region 32A. The limiting section 32C forms a run-out flank (ramp) of the first cam 32.

The limiting section 32C of the first cam 32 and the limiting section 34E of the second cam 34 are of identical configuration. The limiting section 32C of the first cam 32 and the limiting section 34E of the second cam 34 are arranged at an identical circumferential position with regard to a longitudinal axis of the camshaft 12. The limiting sections 32C, 34E form a common flat ramp. In this way, the limiting sections 32C, 34E make it possible that an axial displacement of the cam carrier 14 takes place not only in the base circle region 32A, 34A, but rather additionally in the limiting section 32C, 34E.

Figure 6:
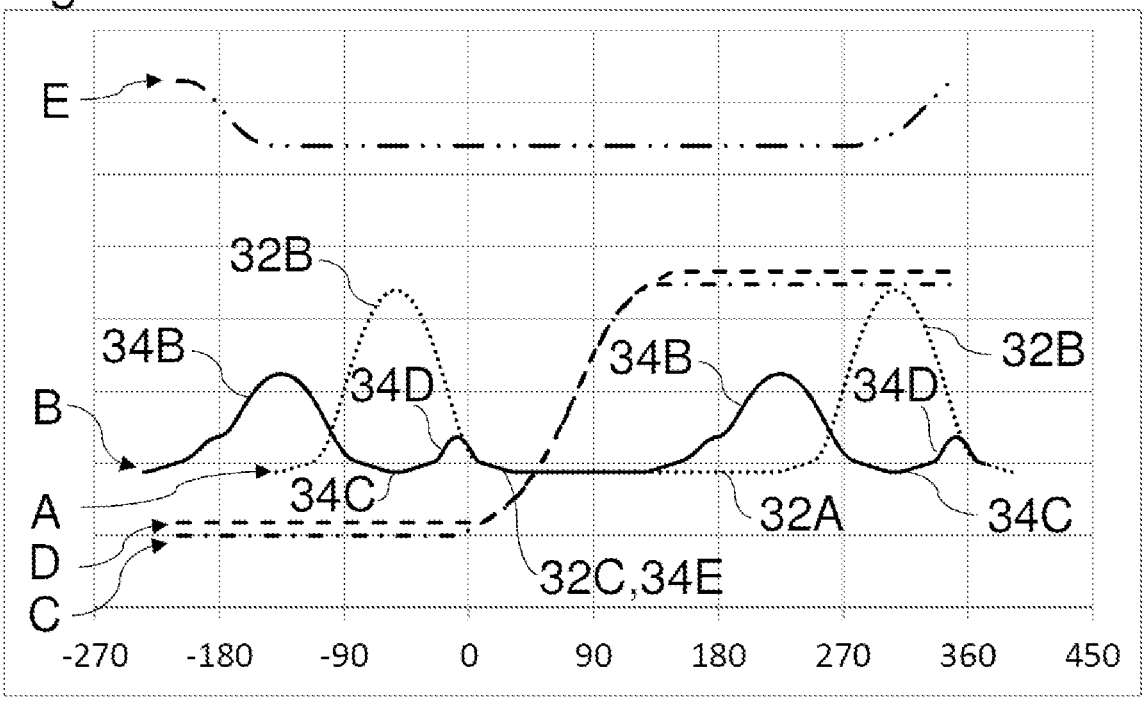
FIG. 6 shows a travel/camshaft angle diagram.
Figure 7:
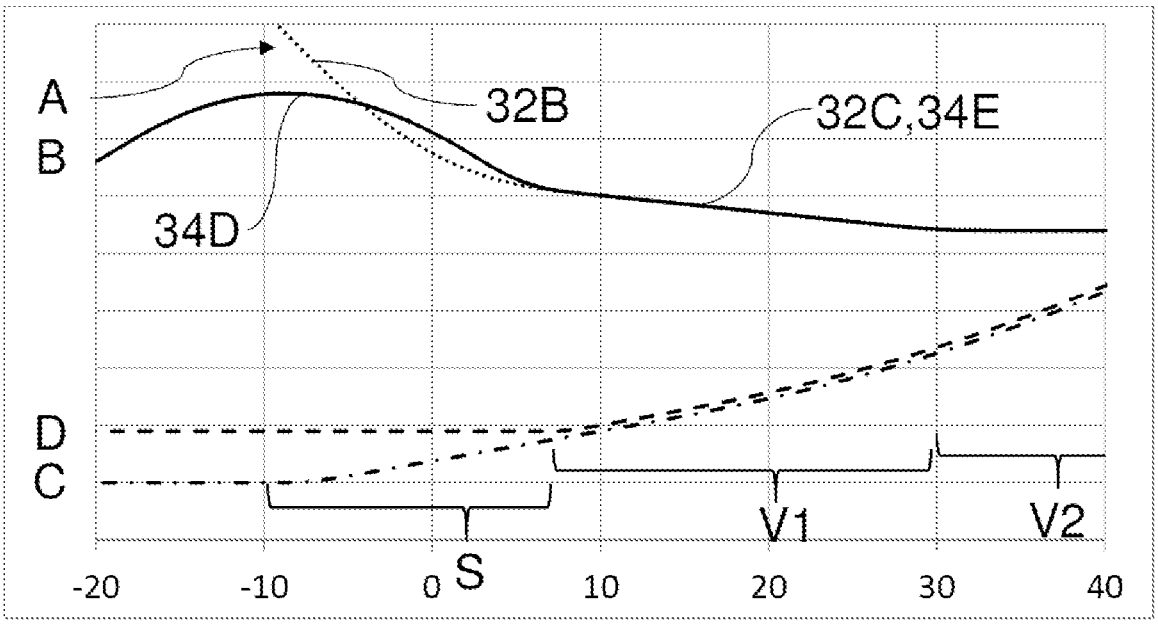
FIG. 7 shows an enlargement of a region of the travel/camshaft angle diagram from FIG. 6.

FIG. 6 shows different curves A to E in a travel/camshaft angle diagram. FIG. 7 shows an enlargement of a region of the diagram of FIG. 6, in which region, in particular, the limiting sections 32C, 34E are shown.

A dotted curve A indicates a valve lift of the outlet valve 20 in accordance with a normal operation mode, as brought about by the first cam 32. The curve A therefore corresponds to a followed cam profile of the first cam 32. In the normal operation mode, the outlet valve 20 is opened by way of the valve lift region 32B during the outlet stroke (exhaust stroke) in order to expel exhaust gas. Otherwise, the outlet valve 20 remains closed on account of the base circle region 32A of the first cam 32.

A continuous curve B indicates a valve lift of the outlet valve 20 in accordance with an engine braking operation mode, as brought about by the second cam 34. The curve B therefore corresponds to a followed cam profile of the second cam 34. In the engine braking operation mode, the outlet valve 20 is opened slightly by way of the first valve lift region 34B towards the end of the compression stroke in the region of the top dead centre at approximately 60° crank angle to 100° crank angle before the top dead centre. This is shown in FIG. 6 in each case at approximately −225° camshaft angle and at approximately 135° camshaft angle. At the top dead centre, the outlet valve 20 is opened further by way of the valve lift region 34B and closes at the end of the expansion stroke approximately at the bottom dead centre. The opening of the outlet valve 20 towards the end of the compression stroke brings it about that the compressed air in the cylinder is pushed through the open outlet valve 20 into the exhaust gas system by way of the piston which is moving towards the top dead centre. The previously performed compression work brakes the crankshaft and therefore the internal combustion engine. The open outlet valve 20 during the expansion stroke brings it about that air is sucked from the exhaust gas lines back into the cylinder. At the end of the expansion stroke, the cylinder is filled substantially with air from the exhaust gas system.

In the engine braking operation mode, the outlet valve 20 can be held closed first of all by way of the second base circle region 34C after the bottom dead centre is reached at the end of the expansion stroke. Towards the end of the exhaust stroke (outlet stroke), the outlet valve 20 opens in the region of the top dead centre by way of the second valve lift region 34D. The opening takes place once again at approximately 60° crank angle to 100° crank angle before the top dead centre. This is shown in FIG. 6 in each case at approximately −45° camshaft angle and at approximately 315° camshaft angle. The closed outlet valve 20 during the first section of the exhaust cycle brings it about that the air which is sucked in the expansion cycle is compressed with the performance of work. The cylinder pressure rises. The compression work brakes the crankshaft and therefore the internal combustion engine. The opening of the outlet valve 20 towards the end of the exhaust stroke leads to the air being pushed through the open outlet valve 20 into the exhaust gas system. In the intake stroke, the cylinder is filled with air again through the open inlet valve or valves. The cycle begins again.

As has been described in the above text, a double compression with a subsequent decompression occurs as a result of the use of the second cam 34 to control the outlet valve 20, with the result that an engine braking functionality is ensured.

As can be gathered, in particular, from FIG. 7, the first cam 32 and the second cam 34 are adapted to one another in such a way that the limiting section 32C of the first cam 32 and the limiting section 34E of the second cam 34 are of the same (identical) configuration. This makes it possible that an axial displacement of the cam carrier 14 can be carried out not only within the base circle regions 32A, 34A. Instead, the axial displacement can additionally take place while the cam follower 16A is operatively connected to one of the limiting sections 32C, 34E. In this way, the axial displacement can begin earlier. This can be followed using the curves C, D and E.

The dash-dotted curve C relates to a movement of the movable pin by one of the actuators 24 or 26 with regard to the cam carrier 14. The dashed curve D relates to a movement of the respective engagement track 42 or 44 and therefore of the cam carrier 14 along the longitudinal axis of the camshaft 12. The double dot-dashed curve E shows a course of a depth contour of the respective engagement track 42 or 44 (shown only in FIG. 6). In the following text, an axial displacement of the cam carrier 14 at the first axial position to the second axial position is described. An axial displacement of the cam carrier 14 from the second axial position to the first axial position takes place in an analogous manner.

First of all, the movable pin of the first actuator 24 is extended in the direction of the first engagement track 42 and in the process engages into the first engagement track 42. The engagement is made possible by way of the configured depth contour of the first engagement track 42 (see curve E). After the engagement, a reduction in the play between the pin of the first actuator 24 and the first engagement track 24 occurs as a result of a cross-sectional constriction of the first engagement track 42. The reduction of the play takes place in a region S (see FIG. 7). The region S is reached and passed through by the pin of the first actuator 24 before the cam follower 16A reaches the limiting section 32C of the first cam 32. When the cam follower 16A finally reaches the limiting section 32C of the first cam 32, the spiral shape begins in the first engagement track 42, whereby an axial displacement of the cam carrier 14 is brought about. A displacement of the cam carrier 14 in a first displacement region V1 therefore already occurs while the cam follower 16A is in contact with the limiting section 32C. The axial displacement of the cam carrier 14 therefore begins before the cam follower 16A reaches the base circle region 32A. In the base circle region 32A, 34A, the axial displacement of the cam follower 16A is carried out further (displacement region V2) and is finally ended before the cam follower 16A reaches the first valve lift region 34B.

The axial displacement of the cam carrier 14 therefore also takes place outside the base circle regions 32A, 34A in the limiting section 32C of the first cam 32 and the limiting section 34E of the second cam 34. As a result, the time period for the axial displacement of the cam carrier 14 is increased. On account of the increased displacement region, the accelerations and therefore the mass forces can be reduced in the case of an identical switching rotational speed for the axial displacement of the cam carrier 14. This can be utilized firstly to increase the functional reliability and service life on account of lower forces and pressures. This can be utilized secondly to increase the maximum switching rotational speed of the system.

In the example which is shown, the additional displacement region V1 which is made possible by way of the limiting sections 32C, 34E of identical configuration extends over approximately 22° camshaft angle.

In order to make an axial displacement of the cam carrier 14 which is shown in the figures possible, it can be necessary to configure the cam-free section 38 which both serves as a zero cam and is provided with the second engagement track 42 with an additional axial tolerance region (clearance region). The adjacent cam 36 is correspondingly of narrower configuration. During the axial displacement within the limiting sections 32C, 34E from the second axial position to the first axial position, the cam follower 18A is then displaced axially within said additional tolerance region. A collision of the cam follower 18A with a cam run-out part of the third cam 36 is thus prevented.

Experts will recognize meanwhile that the sliding cam system which is described herein is not restricted to the application which is described herein. For example, as an alternative or in addition to the identical design of the run-off regions (run-out regions), an identical design of the run-on regions (run-in regions) of the cams can be provided in order to realize the limiting sections of identical configuration. It is also possible to use the principles which are described herein in the case of variable valve trains for inlet valves of an internal combustion engine. Thus, for example, a run-on region of a first cam for a normal operation mode can be of identical design to a run-on region of a second cam for a Miller operation mode, and can be positioned at the same circumferential position with regard to the longitudinal axis of the camshaft.

Furthermore, it is to be emphasized that the displacement apparatus which is disclosed herein (first actuator, second actuator, first engagement track, second engagement track) does not necessarily have to be used to extend the switching region for the axial displacement of the cam carrier. Rather, for example, a method for operating an internal combustion engine with any displacement apparatus for the cam carrier can comprise the displacement of the cam carrier while the cam follower is in contact with the limiting region or regions. In particular, an axial displacement can begin and/or end when the cam follower is in contact with a limiting region.

The present disclosure is not restricted to the above-described preferred exemplary embodiments. Rather, a multiplicity of variants and modifications are possible which likewise utilize the concept of the present disclosure and therefore fall within the scope of protection.

LIST OF REFERENCE SIGNS

10 Variable valve train
11 Sliding cam system
12 Camshaft
14 Cam carrier
16 First transmission apparatus (first rocker arm)
16A Cam follower
18 Second transmission apparatus (second rocker arm)
18A Cam follower
20 First outlet valve
22 Second outlet valve
24 First actuator
26 Second actuator
27 Control unit
28 First stop
30 Second stop
32 First cam
32A Base circle region
32B Valve lift region
32C Limiting section of the valve lift region 32B
34 Second cam
34A First base circle region
34B First valve lift region
34C Second base circle region
34D Second valve lift region
34E Limiting section of the second valve lift region 34D
36 Third cam
38 First cam-free section
40 Second cam-free section
42 First engagement track
44 Second engagement track
46 Locking apparatus
48 Elastic element
50 Locking body
52 First recess
54 Second recess
A Valve control curve according to cam 32
B Valve control curve according to cam 34
C Pin movement
D Engagement track/cam carrier movement
E Depth contour of the engagement track
S Play reduction region
V1 First (axial) displacement region
V2 Second (axial) displacement region

We claim:

1. A sliding cam system for a variable valve train of an internal combustion engine of a motor vehicle, comprising:

a camshaft;

a cam carrier which is arranged on the camshaft fixedly so as to rotate with it and axially displaceably between a first axial position and a second axial position, and comprises a first cam, a second cam and a first engagement track for the axial displacement of the cam carrier;

a cam follower which is operatively connected to the first cam in the first axial position of the cam carrier and is operatively connected to the second cam in the second axial position of the cam carrier; and a first actuator which comprises an element which can be retracted and extended, for engaging into the first engagement track for the axial displacement of the cam carrier;

the first cam and the second cam being arranged offset with respect to one another along a longitudinal axis of the camshaft;

the first cam comprising a base circle region and a valve lift region with a limiting section which adjoins the base circle region of the first cam;

the second cam comprising a base circle region and a valve lift region with a limiting section which adjoins the base circle region of the second cam;

the limiting section of the first cam and the limiting section of the second cam being of identical configuration and being arranged at an identical circumferential position about the longitudinal axis of the camshaft;

the first actuator, the cam follower and the first engagement track being arranged and configured in such a way that an axial displacement of the cam carrier can be carried out while the cam follower is operatively connected to the limiting section of the first cam or the limiting section of the second cam; and the first engagement track comprises a cross-sectional constriction for a reduction of a play between the first engagement track and that element of the first actuator which can be retracted and extended during the engagement, which cross-sectional constriction is arranged in such a way that the reduction of the play takes place before the cam follower passes into an operative connection with the limiting section of the first cam or the limiting section of the second cam.

2. The sliding cam system according to claim 1, wherein the motor vehicle is a commercial vehicle.

3. The sliding cam system according to claim 1, wherein the element which can be retracted and extended is a pin.

4. The sliding cam system according to claim 1, the first actuator, the cam follower and the first engagement track being arranged and configured in such a way that an axial displacement of the cam carrier begins or ends while the cam follower is operatively connected to the limiting section of the first cam or the limiting section of the second cam.

5. The sliding cam system according to claim 1, wherein:

the limiting section of the first cam and the limiting section of the second cam extends over a region of greater than or equal to 1° camshaft angle; or the limiting section of the first cam and the limiting section of the second cam extends over a region of between 5° and 45° camshaft angle.

6. The sliding cam system according to claim 1, wherein the limiting section of the first cam and the limiting section of the second cam form a common flat ramp.

7. The sliding cam system according to claim 1, wherein:

the limiting section of the first cam is arranged in a run-out region of the first cam and the limiting section of the second cam is arranged in a run-out region of the second cam; or the axial displacement of the cam carrier beginning when the cam follower is operatively connected to the limiting section of the first cam or the limiting section of the second cam.

8. The sliding cam system according to claim 7, wherein the axial displacement of the cam carrier ends while the cam follower is operatively connected to the base circle region of the first cam or the base circle region of the second cam.

9. The sliding cam system according to claim 1, wherein:

the limiting section of the first cam is arranged in a run-in region of the first cam and the limiting section of the second cam is arranged in a run-in region of the second cam; or the axial displacement of the cam carrier ends when the cam follower is operatively connected to the limiting section of the first cam or the limiting section of the second cam.

10. The sliding cam system according to claim 9, wherein the axial displacement of the cam carrier begins beginning while the cam follower is operatively connected to the base circle region of the first cam or the base circle region of the second cam.

11. The sliding cam system according to claim 1, the cam carrier including a second engagement track for the axial displacement of the cam carrier in an opposed direction with respect to an axial displacement which is brought about by the first engagement track, and the sliding cam system further comprising:

a second actuator which comprises a second element which can be retracted and extended, for engaging into the second engagement track for the axial displacement of the cam carrier;

the second actuator, the cam follower and the second engagement track being arranged and configured in such a way that an axial displacement of the cam carrier can be carried out while the cam follower is operatively connected to the limiting section of the first cam or the limiting section of the second cam.

12. The sliding cam system according to claim 11, wherein the second element which can be retracted and extended is a pin.

13. The sliding cam system according claim 11, wherein:

the second engagement track comprising a cross-sectional constriction for a reduction of a play between the second engagement track and that element of the second actuator which can be retracted and extended during the engagement, which cross-sectional constriction is arranged in such a way that the reduction of the play takes place before the cam follower passes into an operative connection with the limiting section of the first cam or the limiting section of the second cam.

14. The sliding cam system according to claim 11, wherein:

the first engagement track or the second engagement track extends spirally about the longitudinal axis of the camshaft; or the element of the first actuator or the second actuator which can be retracted and extended is moved radially with regard to the longitudinal axis of the camshaft.

15. A variable valve train for an internal combustion engine, comprising:

a sliding cam system, including:

a camshaft;

a cam carrier which is arranged on the camshaft fixedly so as to rotate with it and axially displaceably between a first axial position and a second axial position, and comprises a first cam, a second cam and a first engagement track for the axial displacement of the cam carrier;

a cam follower which is operatively connected to the first cam in the first axial position of the cam carrier and is operatively connected to the second cam in the second axial position of the cam carrier; and a first actuator which comprises an element which can be retracted and extended, for engaging into the first engagement track for the axial displacement of the cam carrier;

the first cam and the second cam being arranged offset with respect to one another along a longitudinal axis of the camshaft;

the first cam comprising a base circle region and a valve lift region with a limiting section which adjoins the base circle region of the first cam;

the second cam comprising a base circle region and a valve lift region with a limiting section which adjoins the base circle region of the second cam;

the limiting section of the first cam and the limiting section of the second cam being of identical configuration and being arranged at an identical circumferential position about the longitudinal axis of the camshaft; and the first actuator, the cam follower and the first engagement track being arranged and configured in such a way that an axial displacement of the cam carrier can be carried out while the cam follower is operatively connected to the limiting section of the first cam or the limiting section of the second cam;

a gas exchange valve, which is operatively connected to the cam follower, wherein, the first cam and the second cam bringing about different valve lifts, opening times or closing times of the gas exchange valve; and the first engagement track comprises a cross-sectional constriction for a reduction of a play between the first engagement track and that element of the first actuator which can be retracted and extended during the engagement, which cross-sectional constriction is arranged in such a way that the reduction of the play takes place before the cam follower passes into an operative connection with the limiting section of the first cam or the limiting section of the second cam.

16. The variable valve train according to claim 15, wherein the gas exchange valve is an inlet valve or an outlet valve.

17. The variable valve train according to claim 15:

the gas exchange valve being an outlet valve;

the first cam being configured for a normal operation mode of the internal combustion engine, in the case of which the first cam holds the outlet valve open in an exhaust stroke; and the second cam being configured for an engine braking operation mode of the internal combustion engine, in the case of which the outlet valve is first of all held closed in a compression stroke and in the exhaust stroke, and is opened before a top dead centre of a piston movement is reached.

18. The variable valve train according to claim 17, the second cam being configured in such a way that:

the outlet valve opens between 100° crank angle and 60° crank angle before the top dead centre is reached; or, after opening in the exhaust stroke, the outlet valve closes in a region between the top dead centre and 30° crank angle after the top dead centre; or, after opening in the compression stroke, the outlet valve closes in a region between a bottom dead centre and 30° crank angle after the bottom dead centre.

19. A motor vehicle, comprising:

a variable valve train for an internal combustion engine, including:

a sliding cam system, having:

a camshaft;

a cam carrier which is arranged on the camshaft fixedly so as to rotate with it and axially displaceably between a first axial position and a second axial position, and comprises a first cam, a second cam and a first engagement track for the axial displacement of the cam carrier;

a cam follower which is operatively connected to the first cam in the first axial position of the cam carrier and is operatively connected to the second cam in the second axial position of the cam carrier; and a first actuator which comprises an element which can be retracted and extended, for engaging into the first engagement track for the axial displacement of the cam carrier;

the first cam and the second cam being arranged offset with respect to one another along a longitudinal axis of the camshaft;

the first cam comprising a base circle region and a valve lift region with a limiting section which adjoins the base circle region of the first cam;

the second cam comprising a base circle region and a valve lift region with a limiting section which adjoins the base circle region of the second cam;

the limiting section of the first cam and the limiting section of the second cam being of identical configuration and being arranged at an identical circumferential position about the longitudinal axis of the camshaft; and the first actuator, the cam follower and the first engagement track being arranged and configured in such a way that an axial displacement of the cam carrier can be carried out while the cam follower is operatively connected to the limiting section of the first cam or the limiting section of the second cam;

a gas exchange valve, which is operatively connected to the cam follower, wherein, the first cam and the second cam bringing about different valve lifts, opening times or closing times of the gas exchange valve, and the first engagement track comprises a cross-sectional constriction for a reduction of a play between the first engagement track and that element of the first actuator which can be retracted and extended during the engagement, which cross-sectional constriction is arranged in such a way that the reduction of the play takes place before the cam follower passes into an operative connection with the limiting section of the first cam or the limiting section of the second cam.

20. The motor vehicle of claim 19, wherein the motor vehicle is a commercial vehicle.

21. A method for operating an internal combustion engine having a sliding cam system comprising a cam carrier which is arranged fixedly on a camshaft so as to rotate with it and can be displaced axially, having a first cam and a second cam which in each case comprise a base circle region and a valve lift region having a limiting section which is arranged adjacently with respect to a respective base circle region, the limiting section of the first cam and the limiting section of the second cam being of identical configuration and being arranged at an identical circumferential position about a longitudinal axis of the camshaft, and a cam follower which is optionally operatively connected to the first cam or the second cam, the first engagement track comprises a cross-sectional constriction for a reduction of a play between the first engagement track and that element of the first actuator which can be retracted and extended during the engagement, which cross-sectional constriction is arranged in such a way that the reduction of the play takes place before the cam follower passes into an operative connection with the limiting section of the first cam or the limiting section of the second cam, the method comprising:

an axial displacement of the cam carrier, the axial displacement of the cam carrier being carried out while the cam follower is operatively connected to the limiting section of the first cam or the limiting section of the second cam.

22. The method according to claim 21, wherein the axial displacement of the cam carrier begins or ends, while the cam follower is operatively connected to the limiting section of the first cam or the limiting section of the second cam.

23. The method according to claim 21, wherein:

the axial displacement of the cam carrier begins while the cam follower is operatively connected to the limiting section of the first cam or the limiting section of the second cam, or ends while the cam follower is operatively connected to the base circle region of the first cam or the base circle region of the second cam; or the axial displacement of the cam carrier begins while the cam follower is operatively connected to the base circle region of the first cam or the base circle region of the second cam, or ends while the cam follower is operatively connected to the limiting section of the first cam or the limiting section of the second cam.

* * * * *